US010993486B2

(12) United States Patent
Byrne

(10) Patent No.: US 10,993,486 B2
(45) **Date of Patent: *May 4, 2021**

(54) METHOD AND GARMENT FOR ASSISTING A WEARER WITH REGULATING BODY TEMPERATURE

(71) Applicant: THE CLEVELAND CLINIC FOUNDATION, Cleveland, OH (US)

(72) Inventor: Jill Elizabeth Byrne, Wickliffe, OH (US)

(73) Assignee: THE CLEVELAND CLINIC FOUNDATION, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/427,415

(22) Filed: May 31, 2019

(65) Prior Publication Data

US 2019/0281904 A1 Sep. 19, 2019

Related U.S. Application Data

(63) Continuation of application No. 15/201,846, filed on Jul. 5, 2016, now Pat. No. 10,357,068.

(60) Provisional application No. 62/193,212, filed on Jul. 16, 2015.

(51) Int. Cl.
*A41D 13/005* (2006.01)
*A41D 27/20* (2006.01)

(52) U.S. Cl.
CPC ..... *A41D 13/0058* (2013.01); *A41D 27/201* (2013.01)

(58) Field of Classification Search
CPC ..... A41D 13/0058; A41D 27/201
See application file for complete search history.

(56) References Cited

U.S. PATENT DOCUMENTS

| | | | |
|---|---|---|---|
| 2,403,676 | A | 7/1946 | Modlinski |
| 4,033,354 | A | 7/1977 | De Rosa |
| 4,832,030 | A | 5/1989 | De Canto |
| 5,146,625 | A | 9/1992 | Steele et al. |

(Continued)

OTHER PUBLICATIONS

Lango, Thomas, et al. "Cooling vest for improving surgeons' thermal comfort: A multidisciplinary design project." Minimally Invasive Therapy & Allied Technologies 18.1 (2009): 20-29.

(Continued)

*Primary Examiner* — Gloria M Hale
(74) *Attorney, Agent, or Firm* — Tarolli, Sundheim, Covell & Tummino LLP

(57) ABSTRACT

A temperature-regulating garment is provided for assisting a user with regulating body temperature. A garment body has first and second major garment body edges. The garment body has a neckline formed by a least a portion of the first major garment body edge. The garment body has a front right panel, a front left panel, and a back panel. At least one armhole is located laterally between the back panel and a selected one of the right front panel and the left front panel. First and second neck pockets are each configured to accept a temperature-regulating pack. The first neck pocket is disposed upon at least one of the right front panel and the back panel, spanning the first major garment body edge. The second neck pocket is disposed upon at least one of the left front panel and the back panel, spanning the first major garment body edge.

20 Claims, 3 Drawing Sheets

(56) References Cited

U.S. PATENT DOCUMENTS

| | | | | |
|---|---|---|---|---|
| 5,302,806 | A | 4/1994 | Simmons et al. | |
| 6,931,875 | B1 | 8/2005 | Allen et al. | |
| 7,043,765 | B1 | 5/2006 | Otsubo | |
| 7,509,692 | B2 | 3/2009 | Elkins et al. | |
| 8,434,163 | B1 | 5/2013 | Nudo | |
| 8,499,367 | B2 | 8/2013 | Almqvist | |
| 10,357,068 | B2 * | 7/2019 | Byrne | A41D 13/0058 |
| 2002/0092312 | A1 | 7/2002 | Head | |
| 2010/0286755 | A1 | 11/2010 | Gallaher | |
| 2011/0302703 | A1 | 12/2011 | Silverberg | |
| 2012/0167287 | A1 | 7/2012 | Mould-Millman | |
| 2014/0143928 | A1 | 5/2014 | Silverberg | |
| 2014/0317825 | A1 | 10/2014 | Silverberg | |
| 2015/0026862 | A1 | 1/2015 | Silverberg | |
| 2016/0135517 | A1 | 5/2016 | Silverberg | |
| 2017/0013899 | A1 * | 1/2017 | Horton | A41D 1/18 |

OTHER PUBLICATIONS

House, James R., et al. "The impact of a phase-change cooling vest on heat strain and the effect of different cooling pack melting temperatures." European journal of applied physiology 113.5 (2013): 1223-1231.

Gao, Chuansi, Kalev Kuklane, and Ingvar Holmér. "Cooling vests with phase change materials: the effects of melting temperature on heat strain alleviation in an extremely hot environment." European journal of applied physiology 111.6 (2011): 1207-1216.

Pluyter, Jon R., Anne-F. Rutkowski, and Jack J. Jakimowicz. "Immersive training: breaking the bubble and measuring the heat." Surgical endoscopy 28.5 (2014): 1545-1554.

* cited by examiner

METHOD AND GARMENT FOR ASSISTING A WEARER WITH REGULATING BODY TEMPERATURE

RELATED APPLICATIONS

This application is a Continuation of U.S. patent application Ser. No. 15/201,846, filed 5 Jul. 2016 which claims priority from U.S. Provisional Application No. 62/193,212, filed 16 Jul. 2015, the subject matter of both are incorporated herein by reference in its entirety.

TECHNICAL FIELD

This disclosure relates to an apparatus and method for use of a temperature-regulating garment and, more particularly, to a method and garment for assisting a user with regulating their body temperature.

BACKGROUND

Temperature regulation during physical activity can be helpful in providing comfort to an individual. An undesirable body temperature can cause, among other things, an increase in physical stress, and a decrease in comfort, focus, and hydration. Maintaining a desirable temperature could be advantageous in several professions that require some sort of physical activity or occur under potentially adverse working conditions, such as the environment's temperature or appropriate/customary attire.

For example, a surgeon in an operating room is in an environment that often has a starting room temperature of 68-73 degrees Fahrenheit, along with bright (and hot) lights provided to illuminate the surgical site. Surgeons generally wear a uniform that consists of several layers of surgical garments. Also, surgeons are usually required to perform some sort of physical activity while conducting a surgical procedure. The surgeon's body temperature can become uncomfortably high due to the temperature of the room, bright lights, layers of clothing, and physical activity during the surgical procedure.

Workers in many other professions (e.g., firefighters, military personnel, athletes, construction workers, meat packers, and many other types of workers) also often encounter conditions in which the individual's body temperature could reach uncomfortably warm or cool levels, due to local working conditions, including the ambient temperatures. To prevent undesirable body temperatures, individuals can use body temperature-controlling garments to regulate their body's temperature.

The temperature-controlling garments currently on the market have characteristics that could be undesirable in certain situations. Several garments on the market include insulation to maintain the temperature of an ice or heat pack, requiring additional weight of the garment. Other garments are made out of material that must be washed between wears, resulting in additional time and resources consumed for maintenance. Commercially available cooling vests are tethered to pump coolers with tubes and cords, thus restricting the user's movement. Also, due to the additional features (e.g., insulation, reusable cloth material, tethering) the temperature-controlling garments currently on the market are relatively expensive. Further, many current temperature-controlling garments on the market are not designed to specifically target the neck region of the user. Regulating the temperature on an individual's neck could improve the physical performance of the individual according to Tyler and Sunderland, "Cooling the Neck Region During Exercise in the Heat." Journal of Athletic Training 46.1 (2011): 61-68.

SUMMARY

In an aspect, a temperature-regulating garment is provided. A garment body has first and second major garment body edges and first and second minor garment body edges. The garment body has a neckline formed by at least a portion of the first major garment body edge. The garment body has first and second garment body connection edges laterally spaced from both of the first and second minor garment body edges. Each of the first and second garment body connection frontiers extends at least a portion of a longitudinal distance between the first and second major body edges. Each of the first and second garment body connection frontiers extends at least a portion of a longitudinal distance between the first and second major body edges. A right front panel extends longitudinally between the first and second major garment body edges. The right front panel extends laterally between the first minor garment body edge and first garment body connection frontier. The right front panel has right front panel inside and outside surfaces. A left front panel extends longitudinally between the first and second major garment body edges. The left front panel extends laterally between the second minor body edge and second garment body connection frontier. The left front panel has left front panel inside and outside surfaces. A back panel extends longitudinally between the first and second major garment body edges. The back panel extends laterally between the first and second garment body connection frontiers. The back panel has back panel inside and outside surfaces. At least one armhole is located laterally between the back panel and a selected one of the right front panel and the left front panel. A belt is attached to the back panel. The belt has longitudinally spaced first and second belt ends separated by a belt body. The first and second belt ends are capable of being selectively mutually engaged for maintaining the belt body around the back panel and the right and left front panels to secure the temperature-regulating garment around a torso of the user. First and second neck pockets are each configured to accept a temperature-regulating pack. The first neck pocket is disposed upon at least one of the right front panel and the back panel. The first neck pocket spans the first major garment body edge. The first neck pocket is attached to at least one of the right front panel inside surface, right front panel outside surface, back panel inside surface, and back panel outside surface. The second neck pocket is disposed upon at least one of the left front panel and the back panel. The second neck pocket spans the first major garment body edge. The second neck pocket is attached to at least one of the left front panel inside surface, left front panel outside surface, back panel inside surface, and back panel outside surface.

In another aspect, a temperature-regulating garment is provided. A garment body has first and second major garment body edges and first and second minor garment body edges. The garment body has a neckline formed by at least a portion of the first major garment body edge. The garment body has first and second garment body connection edges laterally spaced from both of the first and second minor garment body edges. Each of the first and second garment body connection frontiers extends at least a portion of a longitudinal distance between the first and second major body edges. Each of the first and second garment body connection frontiers extends at least a portion of a longitudinal distance between the first and second major body edges. A right front panel extends longitudinally between the first and second major garment body edges. The right front panel extends laterally between the first minor garment body edge and first garment body connection frontier. The right front panel has right front panel inside and outside surfaces. A left front panel extends longitudinally between the first and second major garment body edges. The left front panel extends laterally between the second minor body edge and second garment body connection frontier. The left front panel has left front panel inside and outside surfaces. A back panel extends longitudinally between the first and second major garment body edges. The back panel extends laterally between the first and second garment body connection frontiers. The back panel has back panel inside and outside surfaces. A belt is attached to the back panel. The belt has longitudinally spaced first and second belt ends separated by a belt body. The first and second belt ends are capable of being selectively mutually engaged for maintaining the belt body around the back panel and the right and left front panels to secure the temperature-regulating garment around a torso of the user. At least one armhole is located laterally between the back panel and a selected one of the right front panel and the left front panel. First and second neck pockets are each configured to accept a temperature-regulating pack. The first neck pocket is disposed upon at least one of the right front panel and the back panel. The first neck pocket spans the first major garment body edge. The first neck pocket is attached to at least one of the right front panel inside surface, right front panel outside surface, back panel inside surface, and back panel outside surface. The second neck pocket is disposed upon at least one of the left front panel and the back panel. The second neck pocket spans the first major garment body edge. The second neck pocket is attached to at least one of the left front panel inside surface, left front panel outside surface, back panel inside surface, and back panel outside surface. At least one of the garment body, first neck pocket, and second neck pocket is formed at least partially from a water-resistant, non-woven cellulosic paper material.

In another aspect, a method for assisting a user with regulating body temperature is provided. A temperature-regulating garment is provided. A garment body has first and second major garment body edges and first and second minor garment body edges. The garment body has a neckline formed by at least a portion of the first major garment body edge. The garment body has first and second garment body connection edges laterally spaced from both of the first and second minor garment body edges. Each of the first and second garment body connection frontiers extends at least a portion of a longitudinal distance between the first and second major body edges. Each of the first and second garment body connection frontiers extend at least a portion of a longitudinal distance between the first and second major body edges. A right front panel extends longitudinally between the first and second major garment body edges. The right front panel extends laterally between the first minor garment body edge and first garment body connection frontier. The right front panel has right front panel inside and outside surfaces. A left front panel extends longitudinally between the first and second major garment body edges. The left front panel extends laterally between the second minor body edge and second garment body connection frontier. The left front panel has left front panel inside and outside surfaces. A back panel extends longitudinally between the first and second major garment body edges. The back panel extends laterally between the first and second garment body connection frontiers. The back panel has back panel inside and outside surfaces. A belt is attached to the back panel. The belt has longitudinally spaced first and second belt ends separated by a belt body. The first and second belt ends are capable of being selectively mutually engaged for maintaining the belt body around the back panel and the right and left front panels to secure the temperature-regulating garment around a torso of the user. At least one armhole is located laterally between the back panel and a selected one of the right front panel and the left front panel. First and second neck pockets are each configured to accept a temperature-regulating pack. The first neck pocket is disposed upon at least one of the right front panel and the back panel. The first neck pocket spans the first major garment body edge. The first neck pocket is attached to at least one of the right front panel inside surface, right front panel outside surface, back panel inside surface, and back panel outside surface. The second neck pocket is disposed upon at least one of the left front panel and the back panel. The second neck pocket spans the first major garment body edge. The second neck pocket is attached to at least one of the left front panel inside surface, left front panel outside surface, back panel inside surface, and back panel outside surface. The garment body is secured about the user's body at least partially through mutually engaging the first and second belt ends. Temperature-regulating packs are placed within at least one of the first and second neck pockets. The temperature-regulating packs are maintained within the first and second neck pockets. At least one temperature-regulating pack assists a user with regulating body temperature.

BRIEF DESCRIPTION OF THE DRAWINGS

For a better understanding, reference may be made to the accompanying drawings, in which.

DESCRIPTION OF EMBODIMENTS

Unless defined otherwise, all technical and scientific terms used herein have the same meaning as is commonly understood by one of skill in the art to which the present disclosure pertains.

As used herein, the singular forms "a," "an" and "the" can include the plural forms as well, unless the context clearly indicates otherwise. It will be further understood that the terms "comprises" and/or "comprising," as used herein, can specify the presence of stated features, steps, operations, elements, and/or components, but do not preclude the presence or addition of one or more other features, steps, operations, elements, components, and/or groups thereof.

As used herein, the term "and/or" can include any and all combinations of one or more of the associated listed items.

As used herein, phrases such as "between X and Y" and "between about X and Y" can be interpreted to include X and Y.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper", "inside", "outside", and the like, may be used herein for ease of description to describe one element or feature's relationship to another element(s) or feature(s) as illustrated in the figures. It will be understood that the spatially relative terms can encompass different orientations of a device in use or operation, in addition to the orientation depicted in the figures. For example, if a device in the figures is inverted, elements described as "under" or "beneath" other elements or features would then be oriented "over" the other elements or features.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present disclosure. The sequence of operations (or steps) is not limited to the order presented in the claims or figures unless specifically indicated otherwise.

The invention comprises, consists of, or consists essentially of the following features, in any combination.

Figure 2:
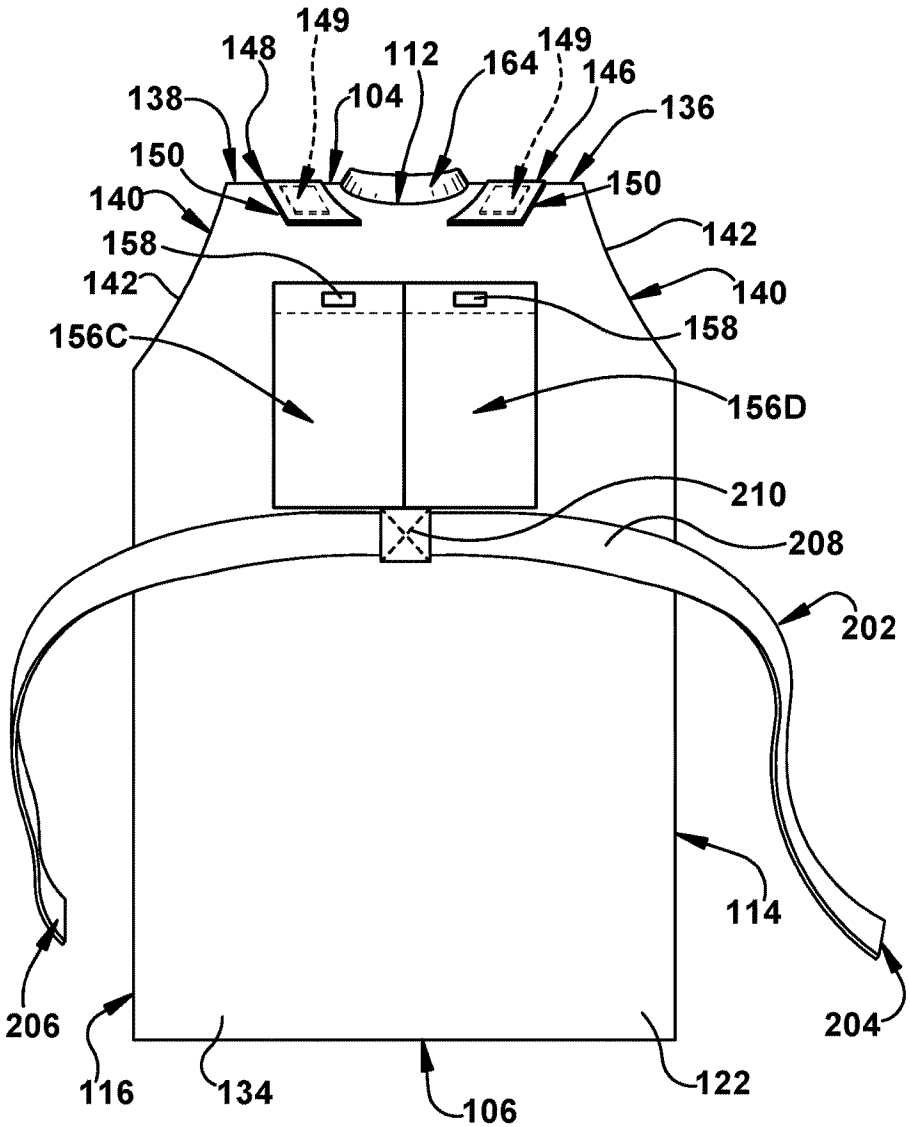
FIG. 2 is a rear view of the garment of FIG. 1.
Figure 1:
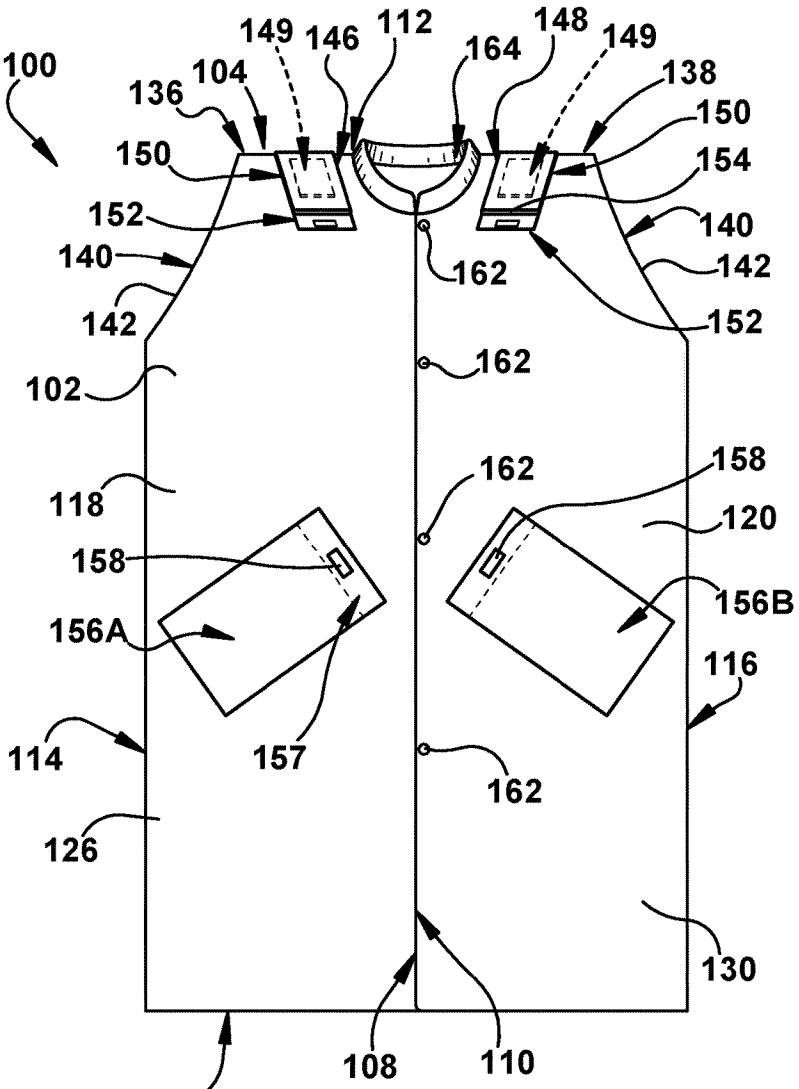
FIG. 1 is a front view of a temperature-regulating garment according to one embodiment.

FIGS. 1-2 depict a temperature-regulating garment 100 including a garment body 102. The garment body 102 has first and second major garment body edges 104, 106 and first and second minor garment body edges 108, 110. A neckline 112 is formed by at least a portion of the first major garment body edge 104. First and second garment body connection frontiers (shown by dashed lines 114, 116, respectively) are laterally spaced from both of the first and second minor garment body edges 108, 110. As used herein, the term "frontier" is defined as a line of division between different or opposed things. The term "lateral" is used herein to indicate a substantially horizontal direction, in the orientation of FIG. 1. The first and second garment body connection frontiers 114, 116 each extend at least a portion of a longitudinal distance between the first and second major body edges 104, 106. The term "longitudinal" is used herein to indicate a direction substantially perpendicular to the "lateral" direction, such as the vertical direction, in the orientation of FIG. 1. The garment body 102 includes a right front panel 118, a left front panel 120, and a back panel 122.

The right front panel 118 extends longitudinally between the first and second major garment body edges 104, 106, and laterally between the first minor garment body edge 108 and the first garment body connection frontier 114. The right front panel 118 has right front panel inside and outside surfaces 124, 126. The left front panel 120 extends longitudinally between the first and second major garment body edges 104, 106, and laterally between the second minor garment body edge 110 and the second garment body connection frontier 116. The left front panel 120 has left front panel inside and outside surfaces 128, 130. The back panel 122 extends longitudinally between the first and second major garment body edges 104, 106, and laterally between the first and second garment body connection frontiers 114, 116. The back panel has back panel inside and outside surfaces 132, 134.

Figure 3:
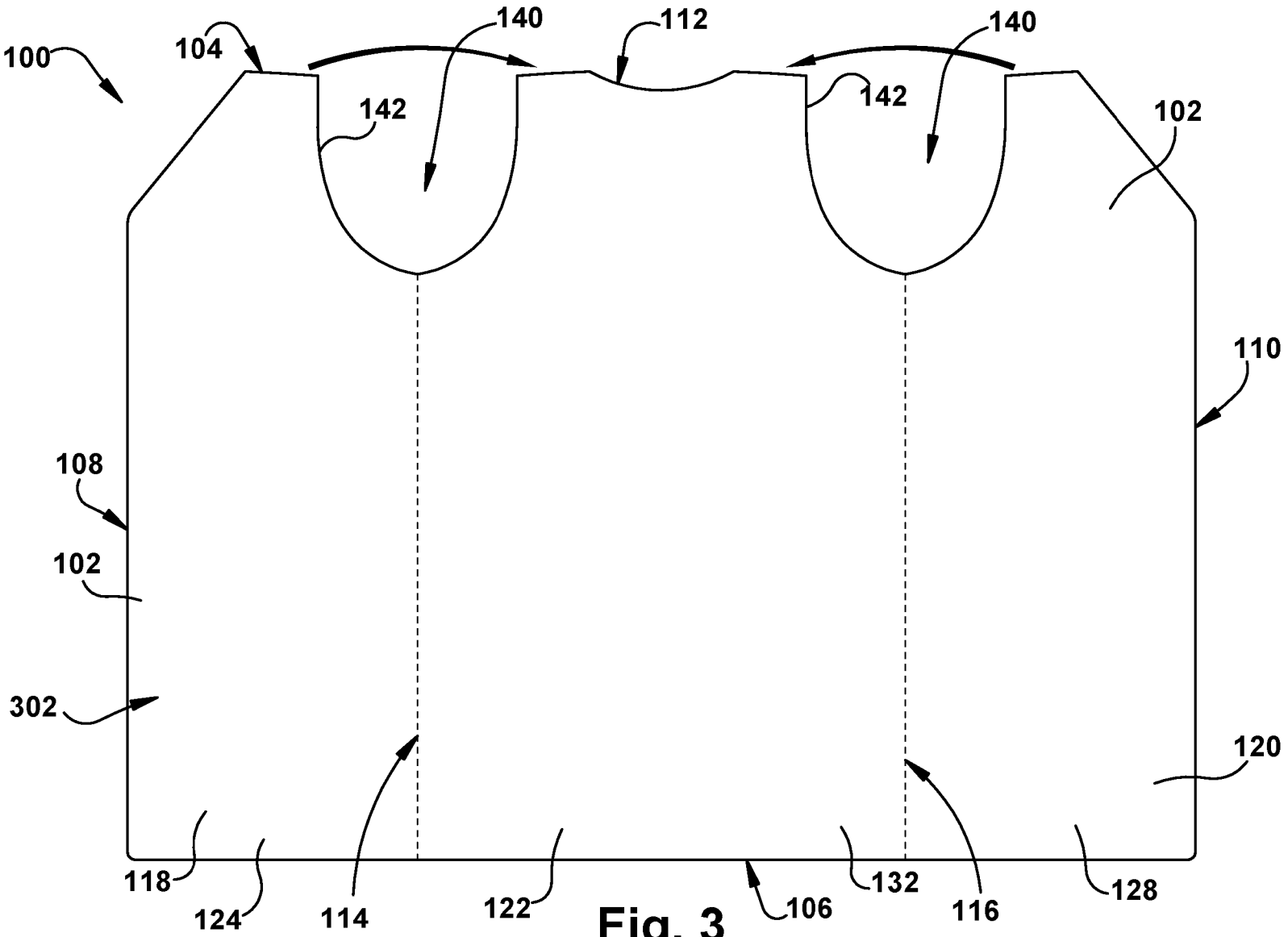
FIG. 3 is an inside plan view of the garment of FIG. 1.

As shown in FIG. 1-3, the garment body 102 can be made substantially of a single material sheet 302. The material sheet 302 may be formed at least partially from at least one of cloth, Tyvek®, plastic, polyester, and Tiburon®. For example, the material sheet 302 may be formed at least partially from a water-resistant, non-woven cellulosic paper material such as, but not limited to, a surgical draping material such as Tiburon®. Areas of the material sheet 302 form the right front panel 118, the left front panel 120, and the back panel 122. The areas of the material sheet 302 are selectively joined together to create the garment body 102. In particular, the right front panel 118 can be folded over at/near the first garment body connection frontier 114 by bringing the first minor body edge 108 toward the center of the back panel 122. Once the right front panel 118 is folded over at/near the first garment connection frontier 114, a right panel joining seam 136 is created by a portion of the first major body edge 104 on the right front panel 118 being joined to a portion of the first major body edge 104 on the back panel 122 in any suitable manner, such as, but not limited to, sewing, stitching, gluing, any variety of temporary or permanent fasteners, or any other suitable attachment scheme or combination of schemes, including the use of intermediate seam bindings or tapes. The left front panel 120 can be folded over at/near the second garment body connection frontier 116 by bringing the second minor body edge 110 toward the center of the back panel 122. Once the left front panel 120 is folded over at/near the second garment connection frontier 116, a left front panel joining seam 138 is created by a portion of the first major body edge 104 on the left front panel 120 being joined to a portion of the first major body edge 104 on the back panel 122 in any suitable manner such as, but not limited to, sewing, stitching, gluing, any variety of temporary or permanent fasteners, or any other suitable attachment scheme or combination of schemes, including the use of intermediate seam bindings or tapes.

Alternatively, the garment body 102 may instead be formed from separate pieces of material being selectively joined together to create the garment body 102. In this alternative configuration, for example, at least a portion of separately provided right and left front panels 118, 120 may be joined to the back panel 122 along the first and second garment body connection frontiers 114, 116, respectively, in any suitable manner, such as, but not limited to, sewing, stitching, gluing, any variety of temporary or permanent fasteners, or any other suitable attachment scheme or combination of schemes, including the use of intermediate seam bindings or tapes. Before or after the connection of the right and left front panels 118, 120 to the back panel 122 along the first and second garment body connection frontiers 114, 116, the right and left panel joining seams 136, 138 may be created in the manner discussed above.

Referring to FIGS. 1-3, at least one armhole 140 is located between the back panel 122 and a selected one of the right front panel 118 and the left front panel 120. Each armhole 140 is capable of receiving one of the user's arms therethrough. As at least one of the right and left front panels 118, 120 are joined to the back panel 122 in the manner discussed above, at least one armhole 140 is created. The armhole 140 has an armhole edge 142, which has longitudinal boundaries of at least one of the right or left panel joining seams 136, 138 and at least one of the first and second garment body connection frontiers 114, 116. The armhole edge 142 has lateral boundaries defined by a selected one of the right and left front panels 118,120 and the back panel 122. For example, the longitudinal boundary of the armhole 140 can be the right panel joining seam 136 and first garment body connection frontier 114, and the lateral boundary can be the right front panel 118 and back panel 122.

At least one sleeve (not depicted) may depend from a corresponding armhole 140. The sleeve, when provided, can be joined to the armhole edge 142 in any suitable manner such as, but not limited to, sewing, stitching, gluing, any variety of temporary or permanent fasteners, or any other suitable attachment scheme or combination of schemes, including the use of intermediate seam bindings or tapes. The sleeve may be formed at least partially from the same material as the material sheet 302, discussed above. The sleeve may be a cap sleeve, a long sleeve, or any variance in between, such as, but not limited to, a short sleeve.

As depicted in FIGS. 1-2, the temperature-regulating garment 100 includes first and second neck pockets 146, 148. At least one of the first neck pocket 146 and the second neck pocket 148 may be formed at least partially from the same material as the material sheet 302, discussed above. The first and second neck pockets 146, 148 are each configured to selectively accept a temperature-regulating pack (shown in dashed line in FIGS. 1-2 at 149), as will be discussed below. As used herein, the term "pack" is defined as a compact unitized assembly to perform a specific function. A temperature-regulating pack 149 can include any suitable pack that provides coldness or heat. The temperature-regulating pack 149 can include, but is not limited to: a single use gel ice pack; a single use ice pack; a reusable gel ice pack; a reusable ice pack; a single use hot pack; a reusable hot pack; a single use hot/cold pack; a reusable hot/cold pack; a sack/bag filled with ice; a sack/bag containing an absorbent pad, cloth, or the like wetted with desired-temperature liquid; or any other desired portable source of heating and/or cooling.

The first neck pocket 146 is disposed on at least one of the right front panel 118 and the back panel 122. The first neck pocket 146 spans the first major garment body edge 104, lying at least partially across the right panel joining seam 136. The first neck pocket 146 is attached to at least one of the right front panel inside surface 124, right front panel outside surface 126, back panel inside surface 132, and back panel outside surface 134. The first neck pocket 146 is temporarily or permanently attached to the garment body 102 in any suitable manner, such as, but not limited to, sewing, stitching, gluing, any variety of temporary or permanent fasteners, or any other suitable attachment scheme or combination of schemes, including the use of intermediate seam bindings or tapes. More detail on the manner in which the first neck pocket 146 is attached to the garment body 102 is discussed below.

The second neck pocket 148 is disposed on at least one of the front left panel 120 and the back panel 122. The second neck pocket 148 spans the first major garment body edge 104 lying at least partially across the left panel joining seam 138. The second neck pocket 148 is attached to at least one of the left front panel inside surface 128, left front panel outside surface 130, back panel inside surface 132, and back panel outside surface 134. The second neck pocket 148 is temporarily or permanently attached to the garment body 102 in any suitable manner, such as, but not limited to, sewing, stitching, gluing, any variety of temporary or permanent fasteners, or any other suitable attachment scheme or combination of schemes, including the use of intermediate seam bindings or tapes. More detail on how the second neck pocket 148 is attached to the garment body 102 is discussed below. The location of the first and second neck pockets 146, 148 allows for a temperature-regulating pack 149 to be held in position on the user's shoulders/neck region.

The first and second neck pockets 146, 148 may each include at least three neck pocket edges 150. At least two of the neck pocket edges 150 may be temporarily or permanently attached to the garment body 102 in any suitable manner, such as, but not limited to, sewing, stitching, gluing, any variety of temporary or permanent fasteners, any other suitable attachment scheme or combination of schemes, including the use of intermediate seam bindings or tapes. The first and second neck pockets 146, 148 each may have at least one neck pocket edge 150 that is not attached to the garment body 102. The unattached neck pocket edge 152, when present, may include at least one neck pocket fastener 154 selectively preventing egress of the temperature-regulating pack 149. The neck pocket fastener 154 can be a hook and loop fastener, snap fastener, hook and eye fastener, button, zipper, or any other suitable fastener, or any combination thereof. Alternatively, all of the neck pocket edges 150 may be attached to the garment body 102 once the temperature-regulating pack 149 is set into at least one of the first and second neck pockets 146, 148. This configuration would include no unattached neck pocket edges 152, and thus the temperature-regulating pack 149 would be completely enclosed within at least one of the first and second neck pockets 146, 148. Completely enclosing the temperature-regulating pack 149 within at least one of the first and second neck pockets 146, 148 would allow for the user to dispose of the temperature-regulating garment 100 without having to remove the temperature-regulating pack 149.

At least one body pocket 156, configured to selectively receive a temperature-regulating pack 149, may be directly attached to at least one of the right front panel inside surface 124, right front panel outside surface 126, left front panel inside surface 128, left front panel outside surface 130, back panel inside surface 132, and back panel outside surface 134. For example, and as shown in FIGS. 1-2, body pockets 156A and 1568 are shown on opposing sides of the user's front torso, and are slanted to facilitate the user's bending at the waist. Body pockets 156A and 156B may also follow the lower intercostal spaces of the ribs, which have muscle and fat tissue that protects organs, such as the stomach, liver and spleen. If the temperature-regulating pack 149 is applied to the lower intercostal spaces of the ribs, the muscle and fat tissue can be affected as desired by the temperature-regulating pack 149, but the organs are insulated from temperature variations by the muscle and fat tissue. Also shown in FIGS. 1-2 are body pockets 156C and 156D which are placed laterally adjacent to each other above the waistline of the user's torso to facilitate the user's bending at the waist. Body pockets 156C and 156D may be vertically placed to align with each side of the user's spine and overlie the tissue that protects and insulates the spine. If a temperature-regulating pack 149 is placed within one or both body pockets 156C, 156D, the tissue can be affected as desired by the temperature-regulating pack 149, while the dermis, fascia, and ligature protects the spine from undesirable temperature changes. The body pocket 156 can be formed at least partially from the same material as the material sheet 302.

The body pocket 156 can include at least one body pocket fastener 158 which can selectively prevent the egress of the temperature-regulating pack 149 from the body pocket 156. The body pocket fastener 158 can be a hook and loop fastener, snap fastener, hook and eye fastener, button, zipper, or any other suitable fastener, or any combination thereof. The body pocket 156 can be temporarily or permanently disposed to the garment body 102 in any suitable manner such as, but not limited to, sewing, stitching, gluing, any variety of temporary or permanent fasteners, any other suitable attachment scheme or combination of schemes, including the use of intermediate seam bindings or tapes. Alternatively, all the edges of the body pocket 156 may be attached to the garment body 102 once the temperature-regulating pack 149 is set into place in the body pocket 156. This configuration would include no unattached body pocket edges 157, and thus the temperature-regulating pack 149 would be completely enclosed within the body pocket 156. Completely enclosing the temperature-regulating pack 149 within the body pocket 156 would allow for the user to dispose of the temperature-regulating garment 100 without having to remove the temperature-regulating pack 149. It is contemplated that the temperature-regulating pack 149 could be joined to at least one of the right front panel inside surface 124, right front panel outside surface 126, left front panel inside surface 128, left front panel outside surface 130, back panel inside surface 132, and back panel outside surface 134 through other means other than by being placed within the body pocket 156, such as through the use of any suitable fastener directly attaching the temperature-regulating pack 149 to the material of the garment body 102. Further, at least one body pocket 156 may be disposed on a sleeve, when present.

At least one selectively operable panel fastener 162 may be provided for engaging the right and left front panels 118, 120 to secure the temperature-regulating garment 100 around a torso of a user. The panel fastener 162 (or sub-components thereof) is located on or adjacent to at least one of the first and second minor body edges 108, 110. The panel fastener 162 can be a hook and loop fastener, snap fastener, hook and eye fastener, button, zipper, or any other suitable fastener, or any combination thereof.

The neckline 112 may include a separately provided collar 164 attached thereto. The collar 164 can be made out of any suitable material, such as cotton or a cotton blend, and may be provided to enhance the user's comfort, to absorb perspiration, to insulate the user from a temperature-regulating pack 149, to prevent any shifting or imbalance of the temperature-regulating garment 100 while on the user, or for any other reason. The collar 164 may be fit closely around the user's neck, for example, in order to balance the shift in weight of the garment caused by the introduction of at least one temperature-regulating pack 149 to at least one of the first neck pocket 146, second neck pocket 148, and body pocket 156. The collar 164 can include an elastic feature that allows the collar 164 to gather closely around the user's neck, such as by being formed from a ribbed material.

As shown in FIG. 2, the temperature-regulating garment 100 may include a belt 202 attached to the back panel 122. The belt 202 may be attached to the back panel 122 in any suitable manner such as by sewing, stitching, gluing, any variety of temporary or permanent fasteners, any other suitable attachment scheme or combination of schemes, including via intermediate seam bindings or tapes. The belt 202 has longitudinally spaced first and second belt ends 204, 206 which are separated by a belt body 208. As used herein, the term "end" can include a small portion of the belt body 208 inward from the extreme belt terminal surfaces. The first and second belt ends 204, 206 are capable of being selectively mutually engaged for maintaining the belt 202 around the back panel 122 and the right and left front panels 118, 120 to secure the temperature-regulating garment 100 around a torso of the user. The first and second belt ends 204, 206 can be engaged through any suitable manner such as by manually tying the first and second belt ends 204, 206 together, sewing, stitching, gluing, any variety of temporary or permanent fasteners, any other suitable attachment scheme or combination of schemes. The belt 202, once engaged around the torso of the user, will help to prevent the temperature-regulating garment 100 from shifting about the torso of the user or gaping open during use.

A patch 210 may be attached to the back panel in a patch position spatially corresponding to a belt position at which the belt 202 is attached to the back panel 122. For example, the patch 210 could underlie the belt 202 at the attachment point of the belt 202 to the garment body 102, whether or not the belt 202 directly contacts the patch 210. The patch 210, when present, may reinforce and strengthen the connection of the belt 202 to the back panel 122, thus helping to prevent unwanted separation of the belt 202 from the back panel 122. At least one of the belt 202 and patch 210 can be formed at least partially from the same material as the material sheet 302, as discussed above.

Figure 5:
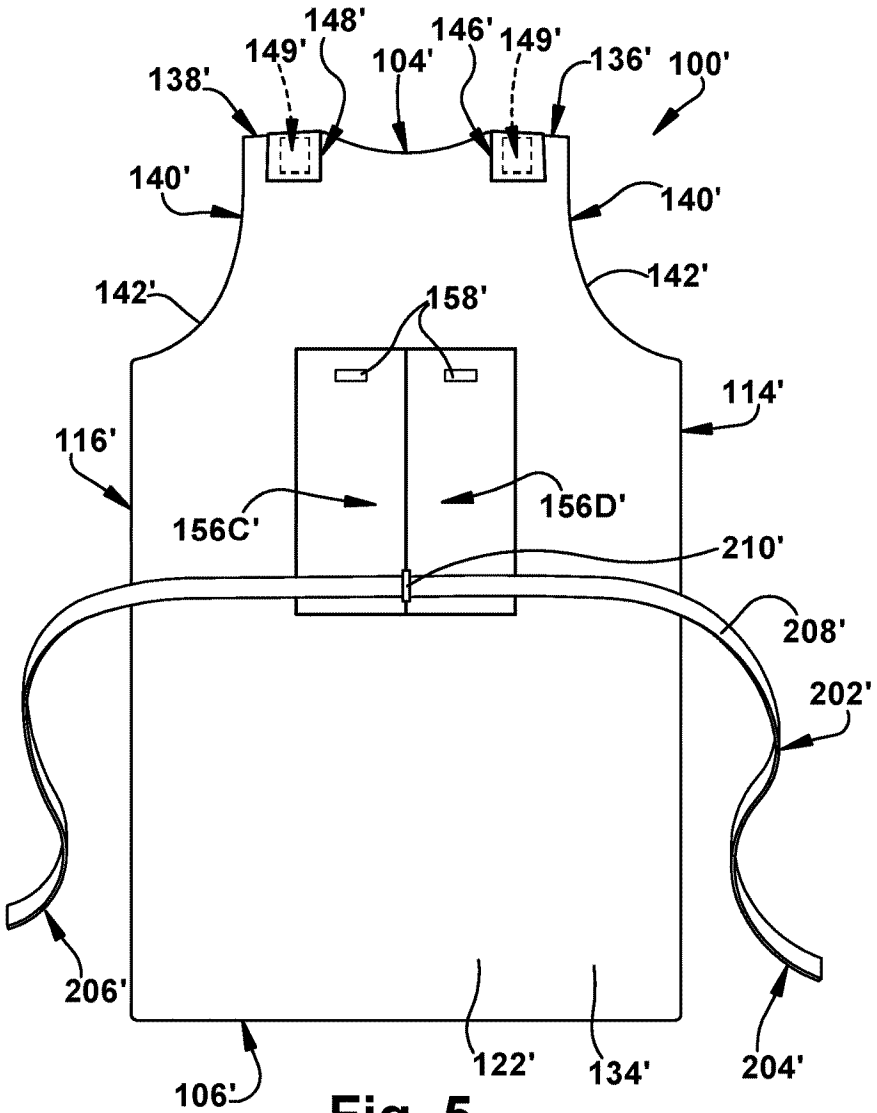
FIG. 5 is a rear view of the garment of FIG. 4.
Figure 4:
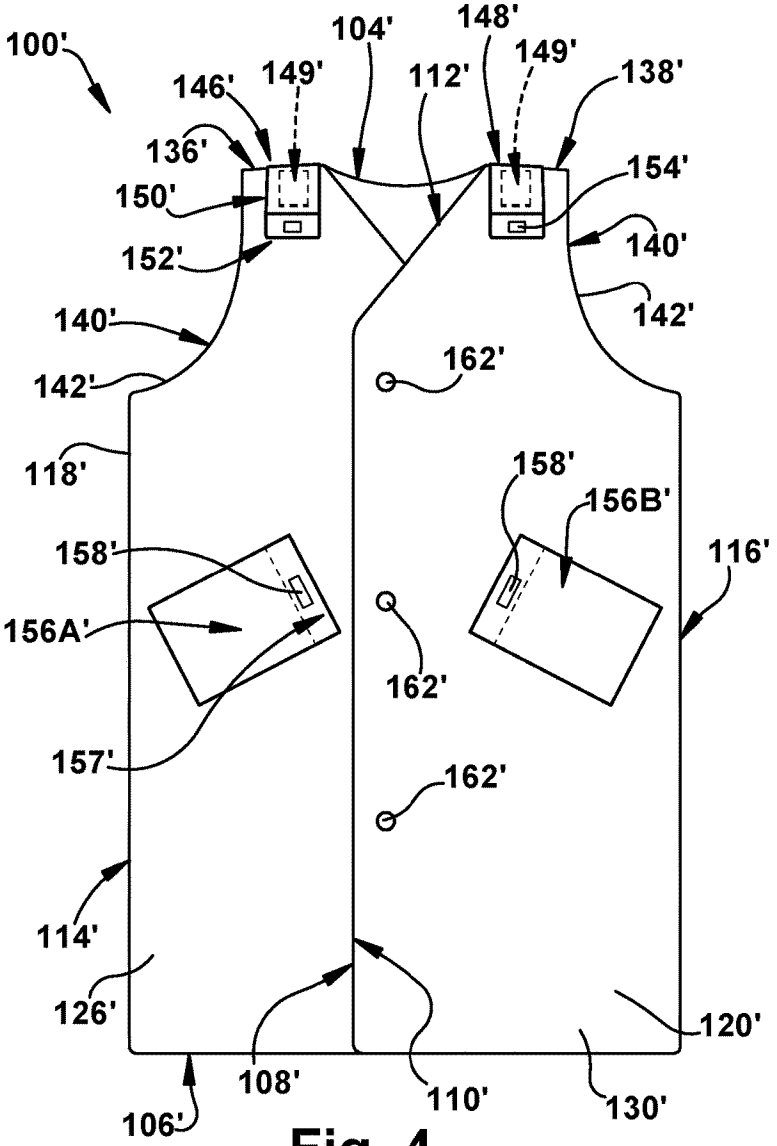
FIG. 4 is a front view of a temperature-regulating garment according to another embodiment.

FIGS. 4-5 depict a temperature-regulating garment 100' of a second embodiment. The temperature-regulating garment 100' of FIGS. 4-5 is similar to the temperature-regulating garment 100 of FIGS. 1-3 and therefore, structures of FIGS. 4-5 that are the same as or similar to those described with reference to FIGS. 1-3 have the same reference numbers with the addition of a "prime" mark. Description of common elements and operation similar to those in the previously described first embodiment will not be repeated with respect to the second embodiment.

The main distinction of the temperature-regulating garment 100' of the second embodiment from that of the first embodiment is the omission of the separately provided collar 164. This embodiment may be useful in reducing weight and expense of the temperature-regulating garment 100.

In use, the temperature-regulating garment 100, as described above, will be provided to the user (who is presumed, solely for the purpose of the below description of use, to also be the wearer). The user will then secure the temperature-regulating garment 100 to his or her body. For example, the temperature-regulating garment 100 can be secured to the user by: the user placing his or her arms through the armholes 140, when present; the user placing his or her neck within the collar 164, when present; the user, or some other individual, fastening the selectively operable panel fasteners 162, when present, to engage the right and left front panels 118, 120 to each other; and, the user, or some other individual, securing the belt 202, when present, around the waist of the user.

Once the temperature-regulating garment 100 is secured to the user, temperature-regulating packs 149 may be placed within at least one of the first and second neck pockets 146, 148. Once the temperature-regulating packs 149 are located within at least one of the first and second neck pockets 146,148, the temperature-regulating packs 149 are maintained within their respective first and second neck pockets 146,148. The temperature-regulating packs 149 can be maintained within the first and second neck pockets 146, 148 through the help of gravity, tightness of fit, or at least one neck pocket fastener 154, when present. For example, the user, after placing the temperature-regulating pack 149 within the first neck pocket 146, can then actuate the neck pocket fastener 154 located on the first neck pocket 146 to prevent egress of the temperature-regulating pack 149 from the first neck pocket 146. Additionally, the temperature-regulating garment 100 may include at least one body pocket 156 configured to hold a temperature-regulating pack 149, as discussed above. The user can place and maintain a temperature-regulating pack 149 within at least one of the available body pockets 156 in a manner similar to that in which the temperature-regulating pack 149 is placed and maintained into the first and second neck pockets 146, 148.

The temperature-regulating pack 149 being held in the temperature-regulating garment 100 will assist the user with regulating body temperature. For instance, if the user is working in an environment in which the user may become uncomfortably warm, cooling temperature-regulating packs 149 may be placed in at least one of the first neck pocket 146, second neck pocket 148, and body pocket 156 of the temperature-regulating garment 100 to assist in keeping the user cooler.

Once the use of the temperature-regulating garment 100 is no longer required, the user can then simply remove the temperature-regulating garment 100. Removal of the temperature-regulating garment 100 may require at least partially destroying the temperature-regulating garment 100, as discussed below. Once the temperature-regulating garment 100 is removed, due to the disposability of the temperature-regulating garment 100, as discussed above, the user can dispose of the temperature-regulating garment 100. However, if it is desired, the user can choose to not dispose of the temperature-regulating garment 100 and instead to re-use the temperature-regulating garment 100.

The temperature-regulating garment 100 may be configured to be used only once due to the qualities of the paper material, such as fragility and/or disposability of the material passively preventing reuse. For example, a surgeon, after a procedure, can simply discard the used temperature-regulating garment 100 in any medically suitable manner (e.g., in biohazard waste as appropriate). Alternatively, the temperature-regulating garment 100 may be configured to be used only once due to the inclusion of frangible features that actively prevent reuse. For example, the selectively operable panel fastener 162 may be configured to prevent the panel fastener 162 from being deactivated once it is selectively operated to secure the temperature-regulating garment 100 around the user's torso. Thus, in order to remove the temperature-regulating garment 100 at the conclusion of the procedure, the surgeon must remove the temperature-regulating garment 100 by destroying the panel fastener 162 (thus preventing reuse of the temperature-regulating garment 100) and/or by tearing the material sheet 302 of the garment body 102. Disposing of the temperature-regulating garment 100 assists the user in preventing any unwanted consumption of time or resources that a reusable garment would consume.

It is contemplated that the temperature-regulating pack 149 can be held in place against the garment body 102 by at least one separate selectively attaching pocket (not depicted). The separate selectively attaching pocket can be placed over the temperature-regulating pack 149, once the temperature-regulating pack 149 is in the desired location, to hold the temperature-regulating pack 149 in that position. The separate selectively attaching pocket can be attached to the garment body 102 in any suitable manner, such as, but not limited to, by sewing, stitching, gluing, any variety of temporary or permanent fasteners, any other suitable attachment scheme or combination of schemes, including the use of intermediate seam bindings or tapes. This configuration would allow a user to create a desired location for a temperature-regulating pack 149 that might have not been available otherwise. The user could just choose a location where they want the temperature-regulating pack 149 to be and then place the separate selectively attaching pocket over the temperature-regulating pack 149, thus holding the temperature-regulating pack 149 in place in that desired location.

While aspects of this disclosure have been particularly shown and described with reference to the example aspects above, it will be understood by those of ordinary skill in the art that various additional aspects may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. Also, although the temperature-regulating garment 100 has been described as being used by a surgeon, it will be understood by those of ordinary skill in the art that the temperature-regulating garment 100 may be used in any suitable environment wherein a user desires, or is required to, wear a garment having the characteristics of the temperature-regulating garment 100. For example, to help prevent workers from developing undesirable body temperatures in other professions (e.g., firefighters, military personnel, athletes, construction workers, meat packers, and many other types of workers), individuals can use the temperature-regulating garment 100 to regulate their body's temperature. In an effort to maintain clarity in the Figures, certain ones of duplicative components shown have not been specifically numbered, but one of ordinary skill in the art will realize, based upon the components that were numbered, the element numbers which should be associated with the unnumbered components; no differentiation between similar components is intended or implied solely by the presence or absence of an element number in the Figures. Any of the described structures and components could be integrally formed as a single unitary or monolithic piece or made up of separate sub-components, with either of these formations involving any suitable stock or bespoke components and/or any suitable material or combinations of materials. Any of the described structures and components could be disposable or reusable as desired for a particular use environment. Any component could be provided with a user-perceptible marking to indicate a material, configuration, at least one dimension, or the like pertaining to that component, the user-perceptible marking potentially aiding a user in selecting one component from an array of similar components for a particular use environment. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one aspect or configuration could be provided, singly or in combination with other structures or features, to any other aspect or configuration, as it would be impractical to describe each of the aspects and configurations discussed herein as having all of the options discussed with respect to all of the other aspects and configurations. A device or method incorporating any of these features should be understood to fall under the scope of this disclosure as determined based upon the claims below and any equivalents thereof.

Other aspects, objects, and advantages can be obtained from a study of the drawings, the disclosure, and the appended claims.

I claim:

1. A temperature-regulating garment, comprising:

a first major garment body edge;

a second major garment body edge;

a first minor garment body edge;

a second minor garment body edge;

a neckline defining a neck opening and formed by at least a portion of the first major garment body edge;

a front panel, the front panel extending longitudinally between the first and second major garment body edges and having front panel inside and outside surfaces;

a back panel, the back panel extending longitudinally between the first and second major garment body edges and having back panel inside and outside surfaces;

a neck region bordering the neckline of the garment, wherein the front panel and the rear panel border the neck region of the garment;

a first pocket proximal to the neck region and disposed upon at least one of the front panel and the back panel, the first pocket being attached to at least one of the front panel inside surface, front panel outside surface, back panel inside surface, or back panel outside surface; and a second pocket proximal to the neck region and disposed upon at least one of the front panel and the back panel, the second pocket being attached to at least one of the front panel inside surface, front panel outside surface, back panel inside surface, or back panel outside surface; and wherein the first pocket and second pocket are configured to contain at least one temperature-regulating pack.

2. The temperature-regulating garment of claim 1, wherein the front panel comprises:

a right front panel, the right front panel extending longitudinally between the first and second major garment body edges, the right front panel having right front panel inside and outside surfaces, wherein the first pocket is disposed upon at least a portion of the right front panel and at least a portion of the back panel; and a left front panel, the left front panel extending longitudinally between the first and second major garment body edges, the left front panel having left front panel inside and outside surfaces, wherein the second pocket is disposed upon at least a portion of the left front panel and at least a portion of the back panel.

3. The temperature-regulating garment of claim 2, further comprising:

at least one first armhole being located laterally between the back panel and the right front panel; and at least a second armhole being located laterally between the back panel and the left front panel.

4. The temperature-regulating garment of claim 2, further comprising:

at least one body pocket, the at least one body pocket being configured to contain a temperature-regulating pack, the body pocket being directly attached to at least one of the right front panel inside surface, right front panel outside surface, left front panel inside surface, left front panel outside surface, back panel inside surface, and back panel outside surface.

5. The temperature-regulating garment of claim 2, further comprising:

a first body pocket attached to at least one of the right front panel inside surface or right front panel outside surface, wherein the first body pocket is slanted; and a second body pocket attached to at least one of the left front panel inside surface or left front panel outside surface, wherein the second body pocket is slanted, and wherein the first body pocket and second body pocket are configured to contain at least one temperature-regulating pack in an orientation that follows the intercostal space of a wearer of the temperature regulating garment's ribs.

6. The temperature-regulating garment of claim 2, further comprising: a belt attached to the back panel, the belt having longitudinally spaced first and second belt ends connected by a belt body, the first and second belt ends being capable of being selectively mutually engaged for maintaining the belt body around the back panel and the right and left front panels to secure the temperature-regulating garment around a torso of the user.

7. The temperature regulating garment of claim 1, further comprising a body pocket attached to at least one of the back panel inside surface, or back panel outside surface, wherein the body pocket is configured to contain at least one temperature-regulating pack.

8. The temperature-regulating garment of claim 2, including at least one selectively operable panel fastener for engaging the right and left front panels to secure the temperature-regulating garment around a torso of a user of the temperature-regulating garment.

9. A temperature-regulating garment, comprising:

a back panel having back panel inside and outside surfaces;

a right front panel connected to the back panel, the right front panel having right front panel inside and outside surfaces;

a left front panel connected to the back panel, the left front panel having left front panel inside and outside surfaces;

a neck opening, wherein the neck opening is defined by and bordered by a neck region, wherein the back panel, right front panel and left front panel border the neck region;

a first pocket proximal to the neck region and disposed upon at least one of the right front panel and the back panel, the first pocket being attached to at least one of the right front panel inside surface, right front panel outside surface, back panel inside surface, or back panel outside surface; and a second pocket proximal to the neck region and disposed upon at least one of the left front panel and the back panel, the second pocket being attached to at least one of the left front panel inside surface, left front panel outside surface, back panel inside surface, or back panel outside surface, and wherein the first pocket and second pocket are configured to contain at least one temperature-regulating pack.

10. The temperature-regulating garment of claim 9, further comprising:

a first body pocket attached to at least one of the right front panel inside surface or right front panel outside surface, wherein the first body pocket is slanted; and a second body pocket attached to at least one of the left front panel inside surface or left front panel outside surface, wherein the second body pocket is slanted, wherein the first body pocket and second body pocket are configured to contain at least one temperature-regulating pack in an orientation that follows the intercostal space of a wearer of the temperature regulating garment's ribs.

11. The temperature-regulating garment of claim 9, further comprising: a belt attached to the back panel, the belt having longitudinally spaced first and second belt ends connected by a belt body, the first and second belt ends being capable of being selectively mutually engaged for maintaining the belt body around the back panel and the right and left front panels to secure the temperature-regulating garment around a torso of the user.

12. The temperature-regulating garment of claim 9, further comprising:

at least one first armhole defined by the back panel and the right front panel; and at least a second armhole defined by the back panel and the left front panel.

13. The temperature-regulating garment of claim 9, including at least one selectively operable panel fastener for engaging the right and left front panels to secure the temperature-regulating garment around a torso of a user of the temperature-regulating garment.

14. The temperature regulating garment of claim 9, further comprising a third body pocket attached to at least one of the back panel inside surface, or back panel outside surface, wherein the third body pocket is configured to contain at least one temperature-regulating pack.

15. A temperature-regulating garment, comprising:

a back panel having back panel inside and outside surfaces;

a right front panel connected to the back panel, the right front panel having right front panel inside and outside surfaces;

a left front panel connected to the back panel and having left front panel inside and outside surfaces;

a neck region bordering and defining a neck opening of the garment, wherein the right front panel, left front panel, and the rear panel border the neck region of the garment;

a first pocket, the first pocket proximal to the neck region and disposed upon at least one of the right front panel and the back panel, the first pocket being attached to at least one of the right front panel inside surface, right front panel outside surface, back panel inside surface, or back panel outside surface; and a second pocket, the second pocket proximal to the neck region and disposed upon at least one of the left front panel and the back panel, the second pocket being attached to at least one of the left front panel inside surface, left front panel outside surface, back panel inside surface, or back panel outside surface; and wherein the first pocket and second pocket are configured to contain at least one temperature-regulating pack.

16. The temperature-regulating garment of claim 15, further comprising:

a first body pocket attached to at least one of the right front panel inside surface, right front panel outside surface, left front panel inside surface, or left front panel inside surface, wherein the first body pocket is slanted on the garment, wherein the first body pocket is configured to contain at least one temperature-regulating pack.

17. The temperature-regulating garment of claim 15, further comprising: a belt attached to the back panel, the belt having longitudinally spaced first and second belt ends connected by a belt body, the first and second belt ends being capable of being selectively mutually engaged for maintaining the belt body around the back panel and the right and left front panels to secure the temperature-regulating garment around a torso of the a user of the temperature-regulating garment.

18. The temperature-regulating garment of claim 15, further comprising:

at least one first armhole defined by the back panel and the right front panel; and at least a second armhole defined by the back panel and the left front panel.

19. The temperature-regulating garment of claim 15, including at least one selectively operable panel fastener for engaging the right and left front panels to secure the temperature-regulating garment around a torso of the a user of the temperature-regulating garment.

20. The temperature regulating garment of claim 15, further comprising a rear body pocket attached to at least one of the back panel inside surface, or back panel outside surface, wherein the rear body pocket is configured to contain at least one temperature-regulating pack.

* * * * *